US011097196B2

(12) United States Patent
Bonfiglioli

(10) Patent No.: US 11,097,196 B2
(45) Date of Patent: Aug. 24, 2021

(54) CAROUSEL FOR AMUSEMENT PARKS WITH DOUBLE MOTORISATION

(71) Applicant: ACHA S.R.L., Bologna (IT)

(72) Inventor: Cesare Bonfiglioli, Castello d'Argile (IT)

(73) Assignee: ACHA S.R.L., Bologna (IT)

( * ) Notice: Subject to any disclaimer, the term of this patent is extended or adjusted under 35 U.S.C. 154(b) by 0 days.

(21) Appl. No.: 16/652,470

(22) PCT Filed: Sep. 4, 2018

(86) PCT No.: PCT/IB2018/056733
§ 371 (c)(1),
(2) Date: Mar. 31, 2020

(87) PCT Pub. No.: WO2019/069151
PCT Pub. Date: Apr. 11, 2019

(65) Prior Publication Data

US 2020/0230509 A1 Jul. 23, 2020

(30) Foreign Application Priority Data

Oct. 4, 2017 (IT) ..... 102017000111190

(51) Int. Cl.
*A63G 31/16* (2006.01)
*A63G 31/06* (2006.01)

(52) U.S. Cl.
CPC ..... *A63G 31/16* (2013.01)

(58) Field of Classification Search
CPC ..... A63G 31/00; A63G 31/06; A63G 31/14; A63G 31/16; A63B 22/02
USPC ..... 472/47, 59–60, 130
See application file for complete search history.

(56) References Cited

U.S. PATENT DOCUMENTS 5,060,932 A * 10/1991 Yamaguchi ..... G09B 9/323 472/47
5,490,784 A * 2/1996 Carmein ..... A63B 22/02 434/29
5,980,256 A 11/1999 Carmein
6,017,276 A 1/2000 Elson et al.
6,629,896 B2 * 10/2003 Jones ..... A63F 13/08 472/60
2006/0213306 A1 9/2006 Hayes et al.

FOREIGN PATENT DOCUMENTS

EP 1875949 A1 9/2008

* cited by examiner

*Primary Examiner* — Kien T Nguyen
(74) *Attorney, Agent, or Firm* — Browdy and Neimark, PLLC

(57) ABSTRACT

A carousel for amusement parks including a spherical casing able to contain at least one passenger; a plurality of rotating bodies able to stay in contact and to receive in support the spherical casing, each of the rotating bodies being able to rotate on itself around at least two respective axes of rotation, of which one steering axis passing through the center of the spherical casing and a rolling axis orthogonal to the steering axis; first motor means able to actuate a first of the rotating bodies in rotation around the respective steering axis; second motor means able to actuate the first rotating body in rotation around the respective rolling axis; and third motor means able to actuate a second of the rotating bodies in rotation around the respective steering axis.

9 Claims, 4 Drawing Sheets

CAROUSEL FOR AMUSEMENT PARKS WITH DOUBLE MOTORISATION

FIELD OF THE INVENTION

The present invention relates to a carousel for amusement parks able to accommodate one or more passengers within a moving environment, for example a closed casing.

STATE OF THE ART

A carousel for amusement parks belonging to the aforementioned type is described in European patent No. EP1875949 filed in the name of the same applicant.

This carousel comprises a spherical casing able to contain one or more passengers, which are securely anchored within the casing by means of appropriate seats or other supports.

The spherical casing is supported on a plurality of rotating bodies, which are associated to a support frame and are distributed around the casing, so as to prevent any translation thereof.

Each of these rotating bodies is able to rotate itself around at least two respective axes of rotation, of which a steering axis passing through the geometric centre of the spherical casing and a rolling axis orthogonal to said steering axis.

In this way, the spherical casing can rotate with respect to the support frame around an infinity of axes rotation passing through its geometric centre, which always remains fixed.

To impart these rotations to the spherical casing, to one of the aforesaid rotating bodies are associated appropriate motor means able to actuate it actively in rotation both around its own steering axis and around its own rolling axis, while all the other rotating bodies are idle and are simply driven by the motion of the spherical casing.

This actuating mode is certainly effective to subject the passengers to centrifugal forces and to accelerations that can continuously vary in direction and magnitude, but it has the drawback of not allowing a particularly precise control of the trajectory that is travelled by the spherical casing.

During the motion, mutual rubbings can take place that cause the loss of the univocal correspondence between the motion of the motorised rotating body and the motion of the spherical casing.

This drawback is particularly relevant when, after performing a series of rotations, the spherical casing has to be brought back to a predetermined starting position in which, for example, the access door of the casing is perfectly aligned to a ramp or to an external ladder able to allow passengers to descend and climb.

To operate this repositioning, it is currently necessary to employ elaborate control system which, in addition to complicating the carousel, make the return run rather slow.

DESCRIPTION OF THE INVENTION

In light of the above, one object of the present invention is to provide a solution that makes it possible to overcome, or at least to significantly mitigate, the aforementioned drawback of the prior art.

Another object is to achieve the aforesaid objective within the scope of a simple, rational solution with relatively low cost.

These and other objects are achieved thanks to the features of the invention which are described in the independent claim 1. The dependent claims outline preferred and/or particularly advantageous aspects of the invention.

In more detail, the present invention makes available a carousel for amusement part comprising:

- a spherical casing able to contain at least one passenger,
- a plurality of rotating bodies able to stay in contact and to receive in support said spherical casing, each of said rotating bodies being able to rotate on itself around at least two respective axes of rotation, of which one steering axis passing through the centre of the spherical casing and a rolling axis orthogonal to said steering axis,
- first motor means able to actuate a first of said rotating bodies in rotation around the respective steering axis,
- second motor means able to actuate said first rotating body in rotation around the respective rolling axis, and
- third motor means able to actuate a second of said rotating bodies in rotation around the respective steering axis.

Thanks to this solution, the rotations imparted to the spherical casing are not controlled by a single rotating body, as took place in the prior art, but are also controlled by a second rotating body which, being actively actuated to rotate around its steering axis, can effectively operate as a sort of rudder.

In this way, the relative rubbings between the spherical casing and the rotating bodies that support it are significantly reduced, making control of the movements more precise.

To further improve the controllability of the movements of the spherical casing, according to an aspect of the invention the carousel can also comprise fourth motor means able to actuate the aforesaid second body rotating around the respective rolling axis.

In this way, the second rotating body does not act only as a rudder but also as a second traction element for the spherical casing.

According to another aspect of the invention, the carousel can comprise an electronic control unit configured to carry out a control cycle that comprises the steps of:

- establishing an operating configuration of the rotating bodies and a time of application, said operating configuration of the rotating bodies comprising at least one orientation of the first rotating body relative to its own steering axis, a velocity of rotation of the first rotating body around its own rolling axis and an orientation of the second rotating body relative to its own steering axis, and
- commanding the motor means in such a way as to impart to the first rotating body and to the second rotating body the set operating configuration and to maintain it for the set application time.

Thanks to this solution, the electronic control unit is effectively able to automatically control the actuation of the first and of the second rotating body and, consequently, the rotations that these two bodies impart to the spherical casing.

Naturally, if the carousel also comprises the fourth motor means, the operating configuration of the first and of the second rotating body can also comprise a velocity of rotation of the second rotating body around its own rolling axis.

The control cycle outlined above can obviously be repeated several times during the operation of the carousel, establishing each time a new operating configuration and a new time of application and commanding the motor means accordingly.

In this way, it is advantageously possible to impart complex movements to the spherical casing, for example continuously varying the velocity and the axis of rotation of the spherical casing within a set of axes passing through its geometric centre.

The total duration of each control cycle, i.e. the time of application of each operating configuration, can be constant for all control cycles and/or can be rather short, for example shorter than one second, so that the global movement of the spherical casing is substantially uniform and continuous.

The operating configuration and the relating time of application can be established by the electronic control unit in a wholly random manner, or they can be established on the basis of a predetermined trajectory to be imparted to the spherical casing.

In other words, the electronic control unit can be configured to establish a trajectory to be imparted to the spherical casing and, on the basis of this trajectory, to determine the operating configuration and the time of application necessary to achieve it.

Since the spherical casing cannot perform translations but only rotations, the term "trajectory" generally means an angular displacement or a sequence of angular displacements that the spherical casing carried out, relative to a fixed reference system, to shift from a predetermined initial position to a final position.

If the trajectory is complex, the electronic control unit can be configured to impart this trajectory to the spherical casing by means of a sequence of consecutive control cycles, for example dividing the trajectory into smaller segments and using each segment of the trajectory to establish an operating configuration of the rotating bodies and the time of application of a corresponding control cycle of the sequence.

In any case, starting from the trajectory to be imparted to the spherical casing (or from a segment thereof), the electronic control unit can be configured to establish the operating configuration of the rotating bodies and the related time of application through a mathematical model or through a pre-constituted map that receives the trajectory as an input and provides as an output the operating configuration of the rotating bodies and the corresponding time of application.

The trajectory can be acquired by the electronic control unit from a list of pre-set trajectories that can be stored in a memory unit, and from which an operator, through appropriate interface means, or the electronic control unit directly, on the basis of a predetermined logic (including randomly), can select the trajectory to be imparted to the spherical casing.

According to an aspect of the invention, the electronic control unit could also be configured to:

- determine an initial position of the spherical casing,
- determine a final position of the spherical casing, and
- determine the trajectory to be imparted to the spherical casing on the basis of said initial position and said final position.

This solution is particularly advantageous when the spherical casing is to reach a specific pre-set final position, as occurs for example during the return travel of the spherical casing, i.e. when the spherical casing has to be brought back to the starting position in which it allows passengers to descend and to climb.

In this context, according to an aspect of the invention the initial position of the trajectory of the spherical casing can be determined by the electronic control unit using an inertial platform mounted aboard the spherical casing.

Thanks to this solution, before determining the trajectory to set to reach the final position, for example to carry out a return run, the electronic control unit is able to know with precision the initial position of the spherical casing.

Thanks to the inertial platform, the electronic control unit can also be able to perform a recursive control on the trajectory that is followed by the spherical casing.

For example, at the end of each control cycle outlined above, the electronic control unit can determine, by means of the inertial platform, the position actually reached by the spherical casing and, on the basis of this information and of the final position to be reached, it can determine the trajectory to set for the next control cycle.

Concerning structural aspects, the rotating bodies can lie substantially coplanar in a horizontal plane and can be arranged mutually angularly equidistant relative to a vertical axis passing through the geometric centre of the spherical casing.

For example, if the rotating bodies were three, they could be arranged 120° from each other, if the rotating bodies were six, they could be arranged 60° from each other, and so on.

In this way, it is possible to assure excellent stability to the spherical casing with hampering its rotational motions.

According to another aspect of the invention, each of said rotating bodies can be rotatably coupled to a respective load-bearing member according to the rolling axis and said load-bearing member can in turn be rotatably coupled to a support frame according to the steering axis.

In this way, a rather simple solution is provided to assure that the rotating bodies have the required degrees of freedom.

For example, each rotating member can be a wheel positioned tangential to the spherical casing and the respective load-bearing member can be a bracket on which said wheel is mounted.

However, some of the rotating bodies, for examples those that are not motorised, can simply be spheres able to rotate idle around any axis passing through their centre.

BRIEF DESCRIPTION OF THE DRAWINGS

Further characteristics and advantages of the invention shall become readily apparent from reading the following description, provided by way of non-limiting example, with the aid of the figures illustrated in the accompanying drawings.

DETAILED DESCRIPTION

From the aforementioned figures, a carousel 100 for amusement parks is observed, which comprises a spherical casing 105 able to contain at least one passenger.

The spherical casing 105 can be constructed as a cage or as a closed body and can be made of metallic material.

For example, the spherical casing 105 can be constructed by welding metal plate wedges with spherical profile and can have two opposite polar areas, open or closed by a cap.

Inside the spherical casing 105 can be installed one or more seats for passengers (not shown), which can be provided with appropriate safety elements, for example seat belts or restraining bars, to stably restrain passengers.

The spherical casing 105 can also have an access door 110, through which passengers can enter and exit.

Figure 3:
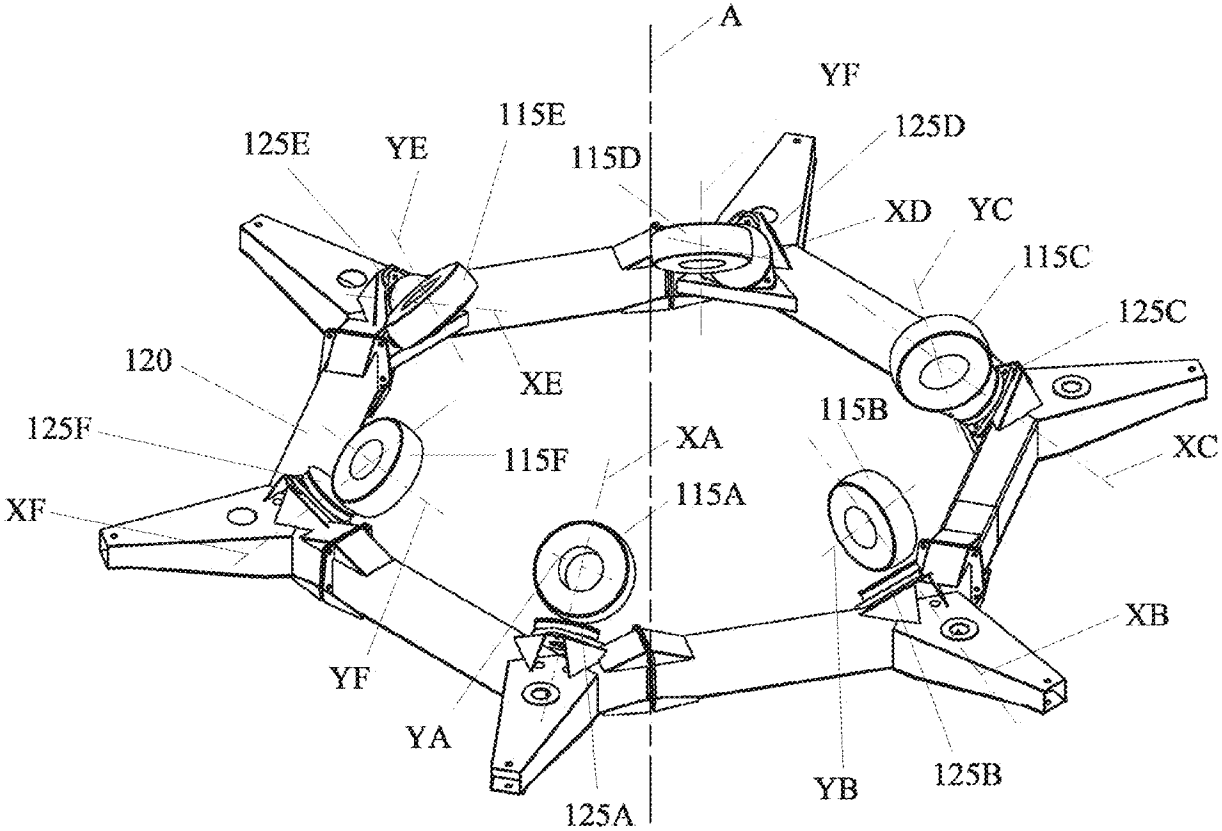
FIG. 3 is an axonometric view of a support frame of the carousel of FIG. 1.

The spherical casing 105 is positioned to bear and be in contact on a plurality of rotating bodies, indicated with the references from 115A to 115F in FIG. 3, which lie substantially on a same horizontal plane and are angularly equidistant from each other relative to a vertical axis A passing through the geometric centre C of the spherical casing 105.

In the illustrated example, the rotating bodies 115-115F are in the number of six and are thus separated by an angular distance equal to 60 sexagesimal degrees relative to the aforesaid vertical axis A.

Each of these rotating bodies 115A-115F can rotate around at least two respective axes of rotation, of which a steering axis XA-XF passing through the geometric centre C of the spherical casing and a rolling axis YA-YF orthogonal and preferably incident to the steering axis XA-XF.

In this way, the spherical casing 105 is securely supported by the rotating bodies 115A-115F, which prevent it from making any translatory movement but allow it to rotate on itself around an infinite number of axes of rotation passing through its geometric centre C which remains fixed.

In the illustrated example each rotating body 115A-115F consists of a wheel, which is positioned tangential to the spherical casing 105 and it is coupled to a support frame 120 through a respective bracket 125A-125F.

Each bracket 125A-125F is rotatably coupled to the support frame 120 so as to have the possibility of rotating around the corresponding steering axis XA-XF, while the respective wheel is rotatably coupled to the bracket 125A-125F so as to have the possibility of rotating around the corresponding rolling axis YA-YF.

The support frame 120 can be common to all the rotating bodies 115A-115F and can have substantially hexagonal shape, at the vertices of which are positioned the brackets 125A-125F.

Figure 5:
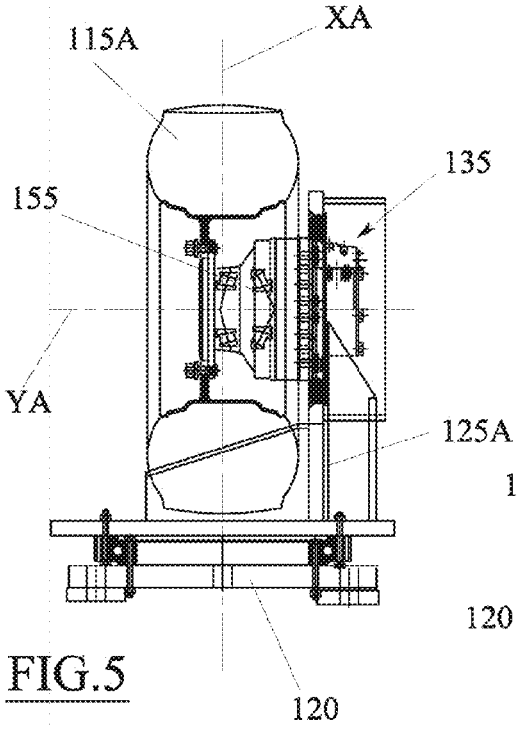
FIG. 5 is the section V-V indicated in FIG. 4.
Figure 4:
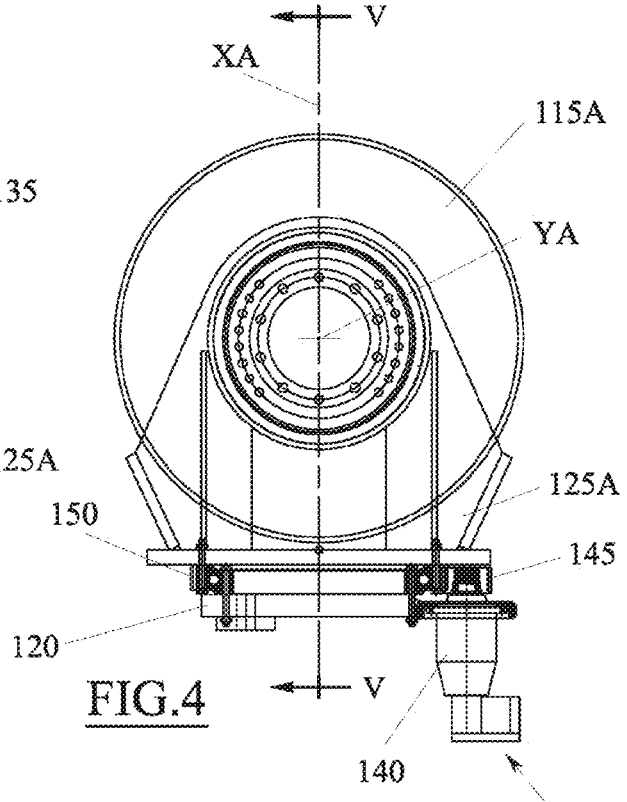
FIG. 4 is a side view of a first motorised wheel of the carousel of FIG. 1.

As shown in FIGS. 4 and 5, to a first rotating body 115A are associated first motor means 130 able to make it rotate around the respective steering axis XA and second motor means 135 able to make it rotate around the respective rolling axis YA.

In particular, in the illustrated example, the first motor means 130 are able to make the bracket 125A of the first rotating body 115A rotate relative to the support frame 120, while the second motor means are able to make the first rotating body 115A (specifically, the wheel) rotate relative to the bracket 125A.

Specifically, the first motor means 130 can comprise a motor 140, for example a hydraulic motor, which can be mounted on the support frame 120 and on whose driveshaft can be splined a pinion 145 which, in turn, is meshed with a corresponding gear wheel 150 mounted on the bracket 125A.

The second motor means 135 can comprise an additional motor 155, for example an additional hydraulic motor, which can be mounted on the bracket 125A and on whose driveshaft the wheel can be splined directly.

Figure 7:
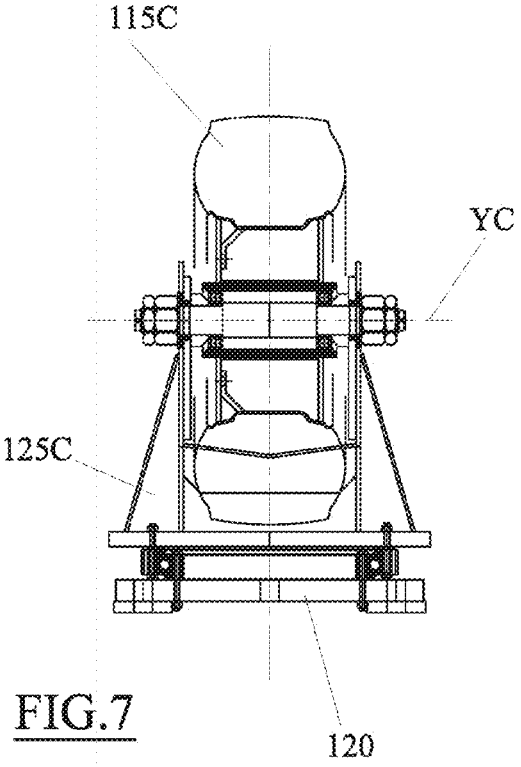
FIG. 7 is the section VII-VII indicated in FIG. 6.
Figure 6:
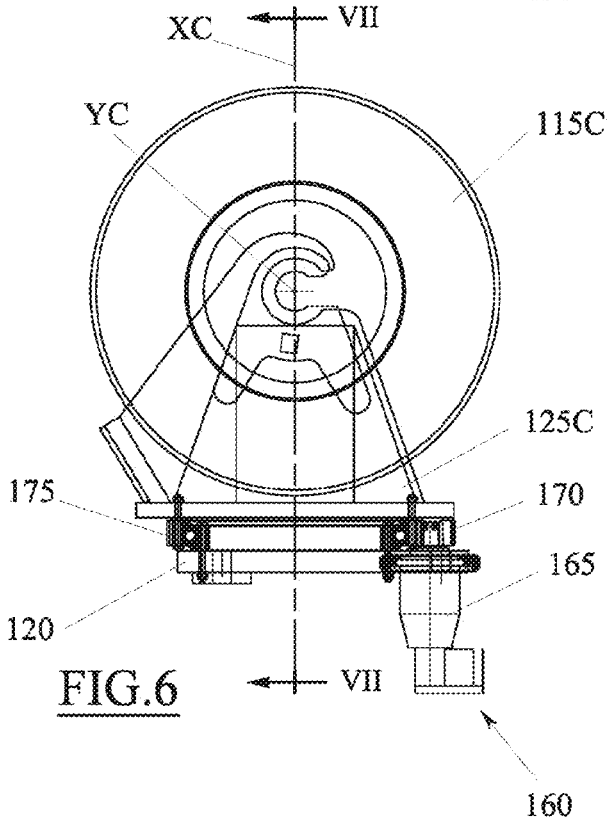
FIG. 6 is a side view of a second motorised wheel of the carousel of FIG. 1.

According to an aspect of the present solution, between the rotating bodies 115A-115F which support the spherical casing 105, is also present a second rotating body 115C to which are associated third motor means 160 able to make them rotate around the respective steering axis XA (see FIGS. 6 and 7).

Similarly to the previous case, the third motor means 160 can be able to make the bracket 125C of the second rotating body 115C (in this case shaped as a fork) rotate relative to the support frame 120, and can comprise a motor 165, for example a hydraulic motor, which can be mounted on the support frame 120 and on whose driveshaft can be splined a pinion 170 meshed with a corresponding gear wheel 175 mounted on the bracket 125C.

In some embodiments, to the second rotating body 115C can also be associated fourth motor means able to make it rotate around the respective rolling axis YC.

These fourth motor means are not illustrated or described in more detail herein because they can be similar to the second motor means 135 provided for the first rotating body 115A.

Figure 2:
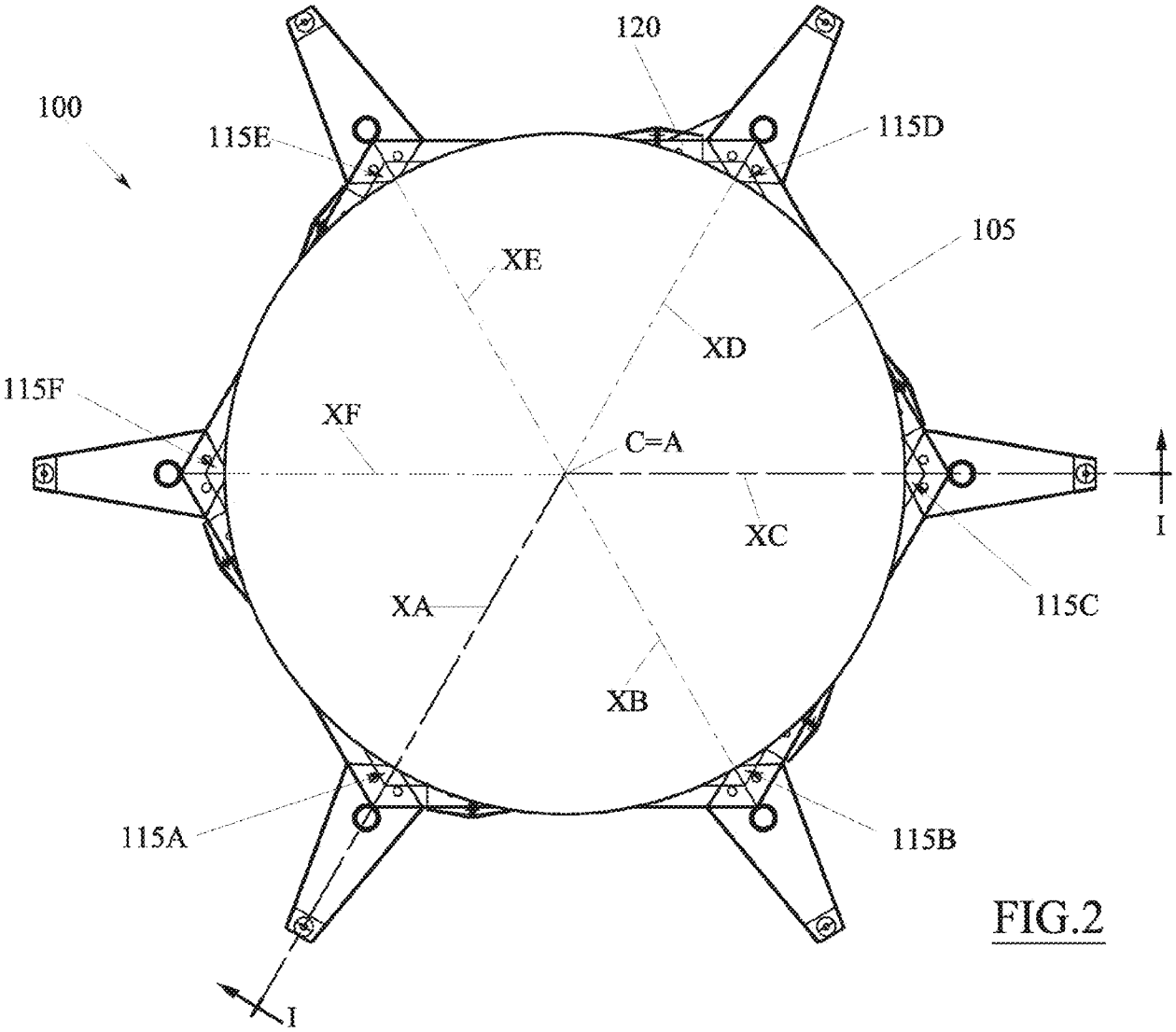
FIG. 2 is a top view of the carousel of FIG. 1.

Preferably, the second rotating body 115C is angularly separated from the first rotating body 115A (relative to the vertical axis A) by an angle that is equal to or greater than 90 sexagesimal degrees (see FIG. 2).

In the example shown, the second rotating body 115C therefore is not one of those positioned immediately adjacent to the first rotating body 115A but it is separated therefrom by 120 sexagesimal degrees.

If the fourth motor means are not present, the second rotating body 115C may be free to rotate idle around its own rolling axis XC.

All the other rotating bodies 115B, 115D, 115E, 115F may be free to rotate idle both relative to their steering axis XB, XD, XE, XF and relative to their rolling axis YB, YD, YE, YF.

Figure 1:
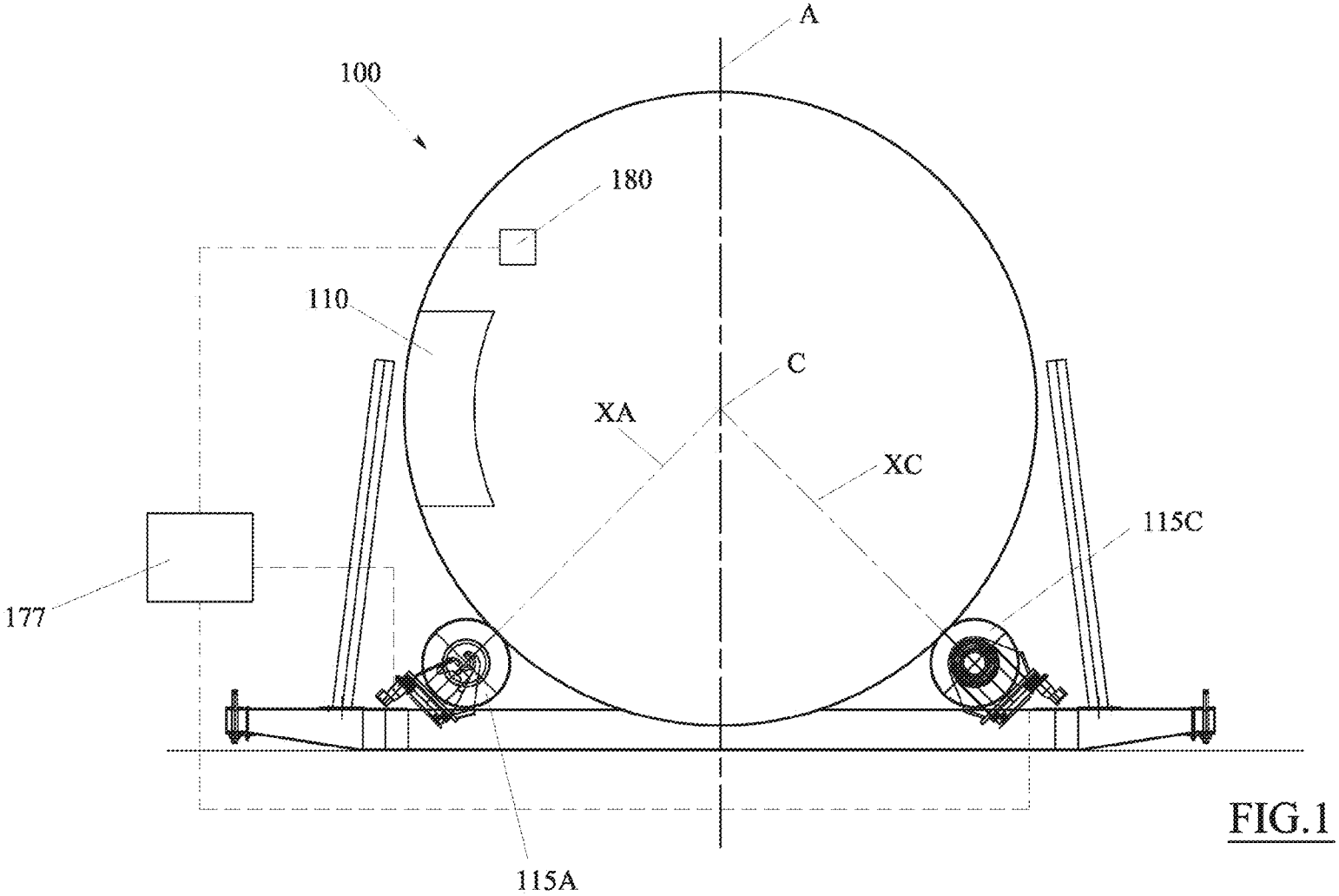
FIG. 1 is a section of a carousel according to an embodiment of the present invention carried out according to the plane I-I indicated in FIG. 2.

The first motor means 130, the second motor means 135, the third motor means 160 and possible also the fourth motor means, are all connected to one electronic control unit, represented schematically and indicated with the numeral 177 in FIG. 1.

The electronic control unit 177 can be further connected, for example by means of a wireless system, to an inertial platform 180 installed in fixed position aboard the spherical casing 105.

Through this inertial platform 180, the electronic control unit 177 is able to detect the actual position of a spherical casing 105 relative to a fixed reference system, for example a reference system integral with the support frame 120 and hence with the ground on which it bears.

The position of the spherical casing 105 can be defined as the relative position between the aforesaid fixed reference system and a mobile reference system integral with the spherical casing 105.

For example, assuming that both these reference systems are Cartesian and that their origin coincides with the geometric centre C of the spherical casing 105, the position of the spherical casing can be defined as the orientation assumed by the reference system integral with the spherical casing 105 relative to the one integral with the support frame 120 and can be expressed, for example, by a set of three angular coordinates.

The operation of the carousel 100 can be described starting from the instant in which the spherical casing 105 is in a predefined starting position, in which, for example, the access door 110 is aligned with a ramp or a ladder for the passengers to climb and descend (not shown).

When the spherical casing 105 is stopped in this starting position, the electronic control unit 177 can be configured to establish a trajectory to be imparted thereto.

Since the spherical casing 105 cannot perform translations but only rotations, the term "trajectory" generally means an angular displacement or a sequence of angular displacements that the spherical casing has to carry out relative to the fixed reference system.

The trajectory can be acquired by the electronic control unit 177 from a list of pre-set trajectories that can be stored in a memory unit (not shown), and from which an operator, through appropriate interface means, or the electronic control unit 177 directly, on the basis of a predetermined logic (including randomly), can select the trajectory to be imparted to the spherical casing.

At this point, the electronic control unit 177 can perform a control cycle that entails first of all establishing, on the basis of the pre-set trajectory, an operating configuration for the first motor means 130, the second motor means 135, the third motor means 160 and possibly also the fourth motor means, and a time of application.

The operating configuration comprises for example at least one orientation of the first rotating body 115A relative to its own steering axis XA, one velocity of rotation of the first rotating body 115A around its own rolling axis YA, an orientation of the second rotating body 115C relative to its own steering axis XC and, if the aforesaid fourth motor means are also provided, also a velocity of rotation of the second rotating body 115C relative to its own rolling axis YC.

Starting from the trajectory to be imparted to the spherical casing 105, the operating configuration of the rotating bodies and the time of application can be established by the electronic control unit 177 through a mathematical model, or through a pre-constituted map that receives the trajectory as an input and provides, as an output, the corresponding operating configuration of the rotating bodies and time of application.

In this regard it should be observed that, to avoid rubbings, the orientation and the velocity of rotation of the second rotating body 115C are generally in univocal relation (obtainable from the geometry of the spherical casing 105) with the orientation and the velocity of rotation of the first rotating body 115A, so that they can be derived from them or vice versa.

At this point, the control cycle can provide that the electronic control unit 177 commands the first motor means 130, the second motor means 135, the third motor means 160 and possibly also the fourth motor means, so as to impart to the first rotating body 115A and to the second rotating body 115C the established operating configuration and so as to maintain it for the established time of application.

Thereby, the spherical casing 105 starts to move from the starting position following the desired trajectory until reaching, at the end of the time of application, a certain final position.

Starting from this final position, the control cycle can naturally be repeated one or more times, each time setting a new trajectory, until the end of the run.

If the desired trajectory is particularly long or complex, the electronic control unit 177 can be configured to impart that trajectory to the spherical casing by means of the repetition in sequence of a plurality of consecutive control cycles.

For example, the electronic control unit 177 can subdivide the trajectory into smaller segments, i.e. in a sequence of shorter, simpler trajectories, and utilise each segment of the trajectory to establish the operating configuration of the rotating bodies and the time of application of a corresponding control cycle of the sequence.

In general, the time of application of each operating configuration, i.e. the total duration of each control cycle, i.e. the time of application of each operating configuration, can be constant for all control cycles and/or can be rather short, for example shorter than one second, so that the global movement of the spherical casing 105 is substantially uniform and continuous.

Once the run is completed, the spherical casing 105 will be in a certain end-of-run position, resulting from the complex of trajectories that were imparted. If, however, during the various displacements, there were rubbings between the spherical casing 105 and the rotating bodies 115A-115F, the end-of-run position could be slightly different from the one assumed and otherwise unknown.

For this reason, the electronic control unit 177 can use the inertial platform 180 and use it to accurately establish the end-of-run position reached by the spherical casing 105.

At this point, the electronic control unit 177 can be configured to make the spherical casing 105 execute a return run, i.e. a run to bring it back to the starting position.

To do this, the electronic control unit 177 can be configured to establish the trajectory to be imposed to the spherical casing 105 on the basis of the end-of-run position, as determined through the inertial platform 180, and the starting position, which can be a known design data item.

In particular, the trajectory can be established by means of a mathematical model that calculates the trajectory to be set as a function of the coordinates of the initial position of the spherical casing 105 (in this specific case, of the end-of-run position) and of the coordinates of the final position (in this specific case, the starting position).

Alternatively, the trajectory could be established through a predetermined map that receives as inputs the coordinates of the initial position and of the final position, and outputs the trajectory.

Once the trajectory is established, the electronic control unit 177 can be configured to execute the same control cycle or the same sequence of control cycles described above.

To speed up the return phase, however, it is possible that, after each control cycle, the electronic control unit 177 measures with the inertial platform 180 the position actually reached by the spherical casing 105 and re-determines the trajectory to be used in the subsequent control cycle, on the basis of this new position and of the final position to be reached (which in the specific case remains the starting position).

It should be observed that, in some embodiments, the latter procedure could also be applied to command the outward run.

Obviously, a person of ordinary skill in the art may make numerous technical and applicational modifications to the carousel 100 described above, without thereby departing from the scope of the invention as claimed below.

The invention claimed is:

1. A carousel for amusement parks comprising:

a spherical casing able to contain at least one passenger, a plurality of rotating bodies configured to stay in contact and to receive in support said spherical casing, each of said rotating bodies being configured to rotate on itself around at least two respective axes of rotation, the at least two respective axes comprising a respective steering axis passing through the center of the spherical casing and a respective rolling axis orthogonal to said steering axis, a first motor configured to actuate a first rotating body of said rotating bodies in rotation around the respective steering axis, and a second motor configured to actuate said first rotating body in rotation around the respective rolling axis, a third motor configured to actuate a second rotating body of said rotating bodies in rotation around the respective steering axis, and an electronic control unit configured to execute a control cycle that comprises the steps of:

establishing an operating configuration of the rotating bodies and a time of application, said operating configuration of the rotating bodies comprising at least one orientation of the first rotating body relative to its own steering axis, a velocity of rotation of the first rotating body around its own rolling axis and an orientation of the second rotating body relative to its own steering axis, and controlling the first, second and third motors to operate to impart to the first rotating body and to the second rotating body the established operating configuration and to maintain the established operating configured for the established time of application.

2. The carousel according to claim 1, further comprising a fourth motor configured to actuate said second rotating body around the respective rolling axis.

3. The carousel according to claim 2, wherein the operating configuration also comprises a velocity of rotation of the second rotating body around its own rolling axis (YC).

4. The carousel according to claim 1, wherein the operating configuration and the time of application are established by the electronic control unit on the basis of a predetermined trajectory to be imparted to the spherical casing.

5. The carousel according to claim 4, wherein the electronic control unit is configured to:

determine an initial position of the spherical casing, determine a final position of the spherical casing, determine the predetermined trajectory to be imparted to the spherical casing based on said initial position and said final position.

6. The carousel according to claim 5, wherein the initial position of the spherical casing is determined by the electronic control unit using an inertial platform mounted aboard the spherical casing.

7. The carousel according to claim 1, wherein said rotating bodies lie substantially coplanar in a horizontal plane and are arranged angularly equidistant from each other with respect to a vertical axis passing through the center of the spherical casing.

8. The carousel according to claim 1, wherein each of said rotating bodies is rotatably coupled to a respective load-bearing member according to the rolling axis and said load-bearing member (125A-125F) is rotatably coupled to a support frame according to the steering axis.

9. The carousel according to claim 8, wherein each rotating member is a wheel positioned tangential to the spherical casing and the respective load-hearing member is a bracket on which said wheel is mounted.

* * * * *